United States Patent [19]

Auerbach et al.

[11] Patent Number: 4,575,871

[45] Date of Patent: Mar. 18, 1986

[54] HELMET LINER FOR CONTAINING WATER

[75] Inventors: Steven L. Auerbach, Fayetteville, N.C.; Sharon J. Conklin, 5434 Wichita Dr., Apt. K-2, Fayetteville, N.C. 28303

[73] Assignee: Sharon J. Conklin, Fayetteville, N.C.

[21] Appl. No.: 487,106

[22] Filed: Apr. 21, 1983

[51] Int. Cl.[4] ..... A42B 3/00

[52] U.S. Cl. ..... 2/6; 2/187; 2/190; 2/209.1; 150/55

[58] Field of Search ..... 2/6, 410, 411, 422, 2/190, 196, 202, 205, 203, 187, 209.1; 150/55; 222/107

[56] References Cited

U.S. PATENT DOCUMENTS

| | | | |
|---|---|---|---|
| 291,679 | 1/1884 | Canning | 2/187 X |
| 2,176,953 | 10/1939 | Bloom | 2/187 |
| 3,055,012 | 9/1962 | Aileo | 2/205 X |
| 3,146,462 | 9/1964 | Militello | 2/205 X |
| 4,124,049 | 11/1978 | Yamaguchi | 222/107 X |
| 4,383,564 | 5/1983 | Hoie | 150/55 |

*Primary Examiner*—Peter Nerbun

[57] ABSTRACT

The present invention comprises a flexible liner for an army helmet or the like and includes a resilient band along its upper edge for stretching it over the open portion or rim of a helmet and for securely holding it to the outer portion of the helmet. The liner is positioned inside the helmet where it forms a reservoir for holding water or the like. The liner when removed from the helmet has a bag-like appearance and includes a pair of handles which can be easily concealed from view between the liner and the helmet and which can, due to its bag-like design, be used to carry items such as water when the liner is detached from the helmet. The liner can also be folded into a substantially rectangular configuration for placement between the webbing of the helmet and the inside top of the helmet for storage purposes. The liner is constructed from a laminate of fabric and a thin, water impermeable rubber layer, which when folded, provides a cushion-like structure useful during paratrooping exercises to prevent impact between the helmet and the soldier's head when placed between the helmet webbing and the helmet.

8 Claims, 4 Drawing Figures

HELMET LINER FOR CONTAINING WATER

BACKGROUND AND OBJECTIVES OF THE INVENTION

Steel helmets or "pots" as they are commonly called have been long used by members of the armed forces for containing water for bathing, shaving or the like during field exercises and under actual combat conditions. Recently the armed services have begun the adoption of a new "Kevlar" helmet to replace the "steel pots" and the new Kevlarhelmets have webbings attached directly thereto and are issued to soldiers without the relatively "stiff" liners as before.

While the new Kevlar helmets provide many advantages over the older steel types, including additional impact resistance, and more comfort and safety, a need has arisen for a liner which can be adapted to the new helmets.

With this background in mind the present invention was developed and one of its objectives is to provide a helmet liner which is flexible and easily positioned in the helmet by stretching it over the open portion or rim of the helmet.

Another objective of the present invention is to provide a helmet liner which is impermeable to water and which has carrying handles.

It is still another objective of the present invention to provide a helmet liner which is flexible and which can be folded and placed between the webbing and the helmet to provide a cushion during paratrooping and other exercises.

It is still another objective of the present invention to provide a helmet liner which is relatively low in cost and which is economical to manufacture.

Other objectives and advantages of the present invention will become apparent to those skilled in the art by reviewing the details of the invention as set forth below.

SUMMARY OF THE INVENTION AND DESCRIPTION OF THE PREFERRED EMBODIMENT

A flexible helmet liner is presented herein which was developed primarily for the new "Kevlar" helmet as used by the United States Army. The helmet liner comprises a somewhat helmet-shaped bag-like member constructed of a thin flexible material and is placed inside the helmet to form a reservoir for water or the like. The helmet liner includes a retaining means and is water impermeable so that the liner can be used for washing, shaving or other purposes by soldiers in the field by removing the helmet and placing the helmet in inverted fashion on the ground or some other convenient location. The soldier can also use the helmet liner for carrying water over short distances, or for carrying ammunition or other items as the device is equipped with handle members which are of a convenient length for carrying it over the shoulder or otherwise.

The preferred form of the invention comprises a flexible helmet liner having a somewhat helmet-sized bag-like appearance formed from a laminate consisting of a first ply of woven fabric. which may be printed, dyed or constructed of fibers forming a camouflage pattern thereon. The camouflage pattern appears on the outer surface of the bag-like member when it is removed from the helmet and when used, for example to carry water from one location to another. The opposite side or inner portion of the flexible liner is comprised of a ply of water impermeable thin rubber material. An elastic band or retaining means is affixed to and is located around the upper or open end of the bag-like member and said elastic band is positioned thereon under tension so that when released the elastic band "gathers" the open end of the bag-like member and causes it to somewhat close. A pair of inverted u-shaped straps are affixed as by sewing to the upper end of the bag-like member and such straps can be conveniently tucked away out of sight during such times as the liner is in place on the helmet. The handle members or straps are also formed with an outer camouflage type design and may extend twelve (12) or more inches from the liner for shoulder carrying.

DESCRIPTION OF THE DRAWINGS

Turning now to the drawings.

Figure 1:
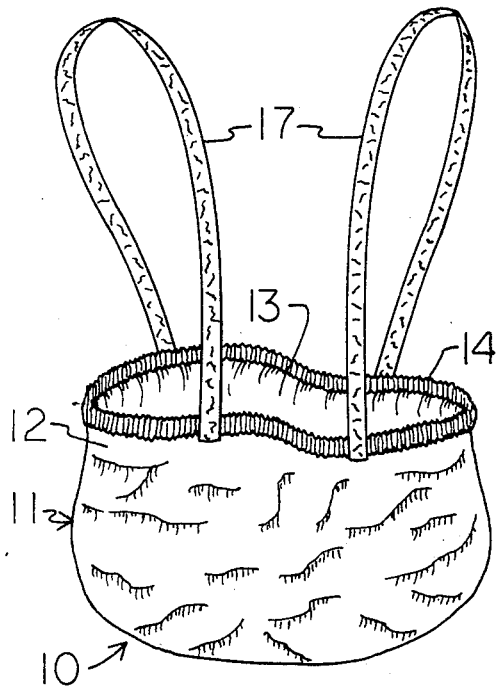
FIG. 1 demonstrates the preferred form of the invention removed from the helmet.

For a more detailed description of the drawings, liner 10 as presented in FIG. 1 comprises a somewhat helmet-shaped bag-like member 11 formed from an outer fabric ply 12 and an inner water impermeable ply 13 which may be of rubber, vinyl or other suitable materials.

Figure 2:
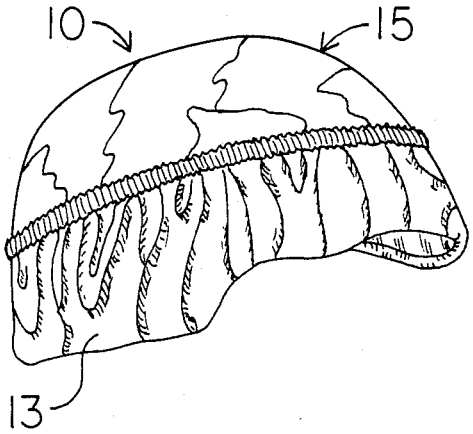
FIG. 2 demonstrates the outside of a typical helmet with the liner of the invention placed thereon.
Figure 3:
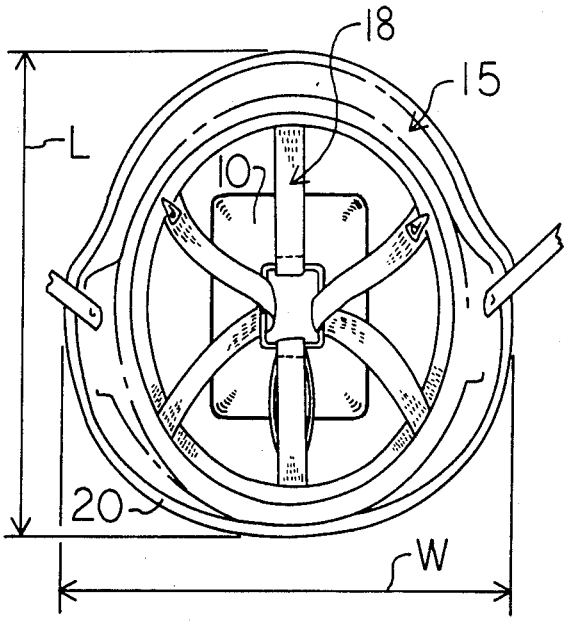
FIG. 3 shows the helmet liner of the invention stored above the webbing of the helmet.

Bag-like member 11 has positioned around its open upper end retaining means 14 which may be for example a sewed-in elastic band. Retaining means 14 could be formed of other suitable materials such as Spandex yarns conventionally knitted or otherwise placed therein as a suitable alternative. Retaining means 14 is attached to bag-like member 11 under tension whereby when relaxed, retaining means 14 tends to gather or slightly close bag-like member 11 as shown in FIG. 1. Retaining means 14 is sized to allow the user to open or stretch it over the open portion or outer perimeter of various size helmet rims and this resilient characteristic also causes liner 10 to securely grip helmet 15 as shown in FIG. 2 with a portion of inner ply 13 exposed along the outside of helmet 15. Kevlar helmets come in four sizes with the largest size having a length dimension "L" as shown in FIG. 3 of approximately $11\frac{3}{8}$ inches and a width dimension "W" of approximately 10 inches. The open end of liner 10 including retaining means 14 will stretch or be openable over rim 20 as shown in FIG. 3 having the above-stated length and width dimensions and will close to grip the outer surface of helmet 15 as shown in FIG. 2. The large size Kevlar helmet 15 is designed to be worn by a soldier having an approximate hat size of $7\frac{3}{8}$ and the smallest size helmet, "x-small" is constructed for the soldier having the approximate hat size of $6\frac{3}{4}$ or less. As would be understood the rim dimensions for the smaller size helmets are less than for the Large size and liner 10 is dimensioned so that it will fit the x-small size although the tension in resilient means 14 is somewhat less when liner 10 is in place on a x-small size than when liner 10 is in place on the larger helmets but in any event resilient means 14 securely holds helmet liner 10 on the outer portion of the various helmet sizes in a satisfactory manner.

Retaining means other than the resilient means shown, such as drawstrings may be satisfactory under particular circumstances for retention purposes.

Figure 4:
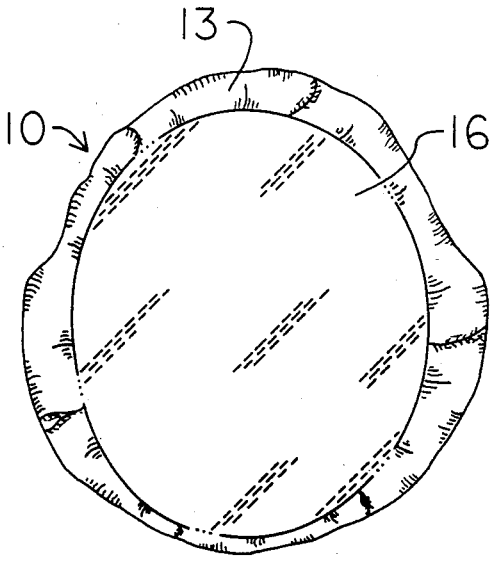
FIG. 4 demonstrates the helmet inverted for an inside view with the liner positioned thereon as in FIG. 2.

FIG. 4 demonstrates the inside of helmet 15 with liner 10 positioned therein containing approximately 2 quarts of water 16 as may be used for shaving or washing purposes and helmet 15 provides support for liner 10 during use. Handle members 17 as shown in FIG. 1 are not visible in either FIG. 2 or FIG. 4 as such handle members are concealed under the liner inside helmet 15, although said handle members are long enough to extend approximately 12 inches from the liner for placing over the user's shoulder for carrying items over long distances and when removed from helmet 15, liner 10 has a capacity of approximately 9/10 of a gallon of water.

As earlier discussed, when not in use liner 10 can be folded and placed under webbing 18 as shown looking into the open or bottom portion of helmet 15 in FIG. 3 whereupon liner 10 then forms a cushion between the wearer's head and helmet 15 during paratrooping or other jarring activities. Being so placed liner 10 is safely, compactly stored and easy for the soldier to reach when needed for personal hygiene purposes or otherwise. Helmet rim 20 is clearly visible in FIG. 3 since liner 10 is not positioned on helmet 15 in this view.

Liner 10 is shown formed from a two ply laminate although a single ply material may be found adequate under certain circumstances. Likewise a laminate of more than two plies may have advantages over the particular embodiment shown herein. The helmet-shaped liner 10 as shown in FIG. 1 is constructed to neatly fit the current issue of Kevlar helmets and other shapes of liner 10 can be made as required for particular applications.

Various modifications and changes can be made to the present invention by those skilled in the art without departing from the scope of the invention and the examples and illustrations as shown herein are for illustrative purposes only and not intended to restrict the scope of the invention.

We claim:

1. An improved helmet and liner combination for containing water or the like, said helmet comprising:

a rigid impact resistant shell, said shell having sides with a terminal rim, said liner comprising:

a flexible water impermeable bag-like member, said bag-like member removably positionable within said shell, said bag-like member having an open end, retaining means, said retaining means attached to said open end of said bag-like member, said bag-like member sized to extend beyond said rim when positioned within said shell for maintaining said open end of said bag-like member over the rim and against the sides of said shell whereby said shell will firmly support said bag-like member during the containment of water.

2. An improved helmet and liner combination as claimed in claim 1 and including a handle member attached to said liner.

3. An improved helmet and liner combination as claimed in claim 1 wherein said retaining means consists of a resilient band.

4. An improved helmet and liner combination as claimed in claim 1 and including a pair of handle members, said handle members attached to said liner.

5. An improved helmet and liner combination as claimed in claim 1 wherein said bag-like member comprises a laminate having two plies.

6. An improved helmet and liner combination as claimed in claim 5 wherein said liner includes a first ply of a textile fabric laminated to a second ply of a resilient material.

7. An improved helmet and liner combination as claimed in claim 5 wherein one of said plies comprises a rubber-like material.

8. An improved helmet and liner combination as claimed in claim 5 wherein said bag-like member is somewhat helmet-shaped.

* * * * *